US011241049B2

(12) United States Patent
Utaka

(10) Patent No.: US 11,241,049 B2
(45) Date of Patent: Feb. 8, 2022

(54) GARMENT HAVING CUP PARTS

(71) Applicant: UTAX CO., LTD., Hyogo (JP)

(72) Inventor: Shohei Utaka, Hyogo (JP)

(73) Assignee: UTAX CO., LTD., Hyogo (JP)

( * ) Notice: Subject to any disclaimer, the term of this patent is extended or adjusted under 35 U.S.C. 154(b) by 312 days.

(21) Appl. No.: 16/331,097

(22) PCT Filed: Jan. 17, 2017

(86) PCT No.: PCT/JP2017/001308
§ 371 (c)(1),
(2) Date: Mar. 6, 2019

(87) PCT Pub. No.: WO2018/047364
PCT Pub. Date: Mar. 15, 2018

(65) Prior Publication Data

US 2019/0200682 A1 Jul. 4, 2019

(30) Foreign Application Priority Data

Sep. 8, 2016 (JP) ..... JP2016-175153

(51) Int. Cl.
*A41C 3/12* (2006.01)
*A41C 3/00* (2006.01)
(Continued)

(52) U.S. Cl.
CPC ..... *A41C 3/12* (2013.01); *A41C 3/00* (2013.01); *A41C 3/0014* (2013.01); *A41C 3/08* (2013.01); *A41F 15/00* (2013.01)

(58) Field of Classification Search
CPC ..... A41C 3/12; A41C 3/00; A41C 3/0014
(Continued)

(56) References Cited

U.S. PATENT DOCUMENTS 1,448,639 A * 3/1923 Reece ..... A41C 3/00 450/59
5,946,944 A 9/1999 Osborne
(Continued)

FOREIGN PATENT DOCUMENTS

JP U-59-125910 8/1984
JP U-63-177920 11/1988
(Continued)

OTHER PUBLICATIONS

International Search Report for PCT/JP2017/001308, dated Apr. 17, 2017.
(Continued)

*Primary Examiner* — Timothy K Trieu
(74) *Attorney, Agent, or Firm* — Stephen J. Weyer, Esq.; Stites & Harbison, PLLC

(57) ABSTRACT

A clothing article having a cup part includes a main body cloth front part 11, a main body cloth rear part 12, and a main body cloth shoulder strap 14 that are formed only of an elastic material. The main body cloth shoulder strap 14 is continuously formed with the main body cloth front part 11 and the main body cloth rear part 12. The main body cloth shoulder strap 14 is larger in width and less prone to stretch at a main body cloth shoulder strap top portion 14*a* than at a main body cloth front part joint portion 15 and at a main body cloth rear part joint portion 16. The main body cloth front part 11 is less prone to stretch at its bust part, and the main body cloth rear part 12 is less prone to stretch at its center zone. The main body cloth rear part joint portion 16 is placed more inward than the main body cloth shoulder strap top portion 14*a* and the main body cloth front part joint portion 15.

7 Claims, 10 Drawing Sheets

(51) Int. Cl.
*A41C 3/08* (2006.01)
*A41F 15/00* (2006.01)

(58) Field of Classification Search
USPC ..... 450/75
See application file for complete search history.

(56) References Cited

U.S. PATENT DOCUMENTS

| | | | | |
|---|---|---|---|---|
| 7,051,557 | B2 | 5/2006 | Mitchell et al. | |
| 2002/0022433 | A1* | 2/2002 | Yeung | A41C 3/0057 450/70 |
| 2004/0003629 | A1* | 1/2004 | Mitchell | A41C 5/00 66/179 |
| 2004/0014394 | A1 | 1/2004 | Mitchell et al. | |
| 2011/0217904 | A1* | 9/2011 | Smith | A41C 3/00 450/86 |
| 2015/0099420 | A1* | 4/2015 | Reinhard | A41C 3/02 450/58 |
| 2017/0290376 | A1* | 10/2017 | Maheshwari | A41C 3/0014 |

FOREIGN PATENT DOCUMENTS

| | | |
|---|---|---|
| JP | U-01-037408 | 3/1989 |
| JP | U-03-001906 | 1/1991 |
| JP | A-10-310907 | 11/1998 |
| JP | A-2000212802 | 8/2000 |
| JP | U-3131863 | 4/2007 |
| JP | U-3150496 | 4/2009 |
| JP | 2015-190079 A | 11/2015 |
| JP | U-3204056 | 4/2016 |
| JP | U-2016089287 | 5/2016 |

OTHER PUBLICATIONS

Written Opinion of the International Searching Authority for PCT/JP2017/001308, dated Apr. 17, 2017.

* cited by examiner

GARMENT HAVING CUP PARTS

TECHNICAL FIELD

The present invention relates to a clothing article having a cup part. More particularly, the present invention relates to a brassiere for a female wearer or a camisole having a cup part for a female wearer.

BACKGROUND ART

A clothing article having a cup part, such as a typically sewn brassiere, includes a very elastic rubber or powernet. A clothing article having a cup part also includes a wire for shape compensation or complementing, or a hook and eye for size adjustment. This configuration increases a tightness of fit on a wearer' body. With the increased tightness of fit, a conventional clothing article having a cup part is designed to have a small area of a material covering the wearer's body and is also designed to have a shoulder strap being small in width, so that the clothing article is less frequently exposed from an opening of a garment worn over the clothing article and thus provides an increased degree of freedom in the garment worn over the clothing article. In a contrast, the increased tightness of fit or hardness of an element causes an increased burden when the clothing article is worn, so that the wearer is apt to be exposed to a pain or a skin rash due to strong pressure on the wearer's body or skin.

In order to achieve a soft wearing comfort with less burden to a wearer's body, brassieres and others formed only of a material and not including any of various components (e.g., a rubber, a powernet, or a shoulder strap) of a typical brassiere or others have been proposed, some of which have been commercially available. For example, Patent Literature 1 discloses a clothing article having a cup part. The clothing article retains a good wearing comfort to cause a wearer to sleep comfortably in a posture of sleeping in bed. Further, the clothing article is improved in wearing stability so as to provide the wearer with a feeling of support.

FIG. 1 is a developed view of a conventional, commercially available brassiere formed only of a free cut material (material that is less prone to fray without raw edge finishing). A brassiere 9 includes a front part 91, a rear part 92, and a shoulder strap 93. A cloth for the shoulder strap 93 is large in width (40 mm or more), and the rear part 92 is also large in such a manner as to cover an entire back of a wearer. The reason for the above is that the brassiere 9 is formed only of a material. In other words, if the shoulder strap 93 is smaller in width, the shoulder strap 93 is pulled by a weight of the wearer's breasts, thereby biting into the wearer's shoulder in the shape of a thinner string. In addition, if the cloth covering the wearer's back is reduced in area, the cloth corresponding to the rear part 92 is pulled by the breasts via the shoulder strap 93 to slide upward without having a sufficient strength to support the breasts, resulting in an unstable wearing condition.

CITATION LIST

Patent Literature

Patent Literature 1: JP 2015-190079 A

SUMMARY OF INVENTION

Technical Problems

However, when the cloth for the shoulder strap 93 is larger in width and the cloth area for the rear part covering the wearer's back is also larger, despite providing the soft and tender wearing comfort, the brassiere is less prone to release the wearer's body heat and thus is unsuitable for wearing, particularly in a hot season. In addition, when a wide-open garment is worn over the brassiere from the wearer's neck toward breasts, shoulder, back, or others, a part of the brassiere is exposed, causing the brassiere to have a restriction on an outerwear to be worn with or a season to be worn.

The present invention has been developed in view of such problems, and an object of the present invention is to provide a clothing article having a cup part. The clothing article is formed only of a material, is easily worn even in a hot season while retaining the soft and tender wearing comfort, and is less prone to be exposed even with a wide-open garment worn over the clothing article.

Solutions to Problems

In order to solve the problems and achieve the object. A clothing article having a cup part according to the present invention includes a front part including the cup part, a rear part, and a shoulder strap. In the clothing article, the front part, the rear part, and the shoulder strap are formed only of an elastic material, the shoulder strap is continuously formed with the front part and the rear part, the shoulder strap is less prone to stretch at a top of the shoulder strap than at a border between the shoulder strap and the front part and at a border between the shoulder strap and the rear part, and the border between the shoulder strap and the rear part is placed more inward than the top of the shoulder strap and the border between the shoulder strap and the front part.

In this configuration, it is possible to prevent the shoulder strap from becoming thinner and biting into a wearer's shoulder. In other words, instead of including any of various components of a typical brassiere that is apt to cause a burden or a feeling of strong pressure on the wearer's body and skin when the brassiere is worn, the clothing article retains a soft and tender wearing comfort without a stress on the skin. In addition, with a shoulder strap being small in width and a significantly small area of the material covering the wearer's body, the clothing article is easily worn even in a hot season and less prone to be exposed even with a wide-open garment worn over the clothing article. The clothing article also prevents the shoulder strap from falling off the wearer's shoulder.

The front part, the rear part, and the shoulder strap are preferably formed of a single sheet of continuous elastic material.

The shoulder strap is preferably larger in width at the top of the shoulder strap than at the border between the shoulder strap and the front part and at the border between the shoulder strap and the rear part. With the shoulder strap being larger in width at the top of the shoulder strap than at the border between the shoulder strap and the front part and at the border between the shoulder strap and the rear part, it is possible to prevent the shoulder strap from becoming thinner and formed in a string shape.

Further, at the border between the shoulder strap and the front part and at the border between the shoulder strap and the rear part, the shoulder strap is preferably formed in a sector shape, widening at a lower end toward the front part and at a lower end toward the rear part. This configuration causes a weight of the wearer's breast to be efficiently transferred to the shoulder strap. In a case that each of the border between the shoulder strap and the front part and the border between the shoulder strap and the rear part is formed in an L-shape or a similar shape to the L-shape, force is concentrated on the L-corner and thus, it is difficult to efficiently spread the force toward the front part and the rear part. Even when the clothing article is formed of a free cut material, the material is apt to be torn at the L-corner.

Here, a bust part of the front part, the shoulder strap, and a region in the rear part extending in a predetermined width from a center of the rear part are preferably less prone to stretch than other parts.

In the region of the front part that is more restricted in stretch than the other parts, a region from a lower end of the cup part toward the border between the front part and the shoulder strap is preferably formed in a continuous curve toward the shoulder strap.

This configuration causes the weight of the breast to be efficiently transferred to the shoulder strap, while providing the soft and tender wearing comfort.

Further, each of the front part, the rear part, and the shoulder strap preferably includes a main body cloth and a patch cloth that are formed of an elastic material and bonded to each other.

This configuration increases a tightness of fit of the bust part, brings the clothing article into contact with the wearer's body without clearance, and prevents the underbust part from sliding up, so as to stably provide an excellent wearing comfort.

Advantageous Effect of Invention

A clothing article having a cup part according to the present invention is formed only of a material, instead of including any of various components of a typical brassiere, to retain a soft and tender wearing comfort. In addition, with a shoulder strap small in width and a significantly small area of the material covering a wearer's body, the clothing article is easily worn even in a hot season and is less prone to be exposed even with a wide-open garment worn over the clothing article.

DESCRIPTION OF EMBODIMENTS

Embodiments of the present invention will be described below.

A first embodiment will be described with reference to a brassiere as an example of a clothing article having a cup part.

Figure 1:
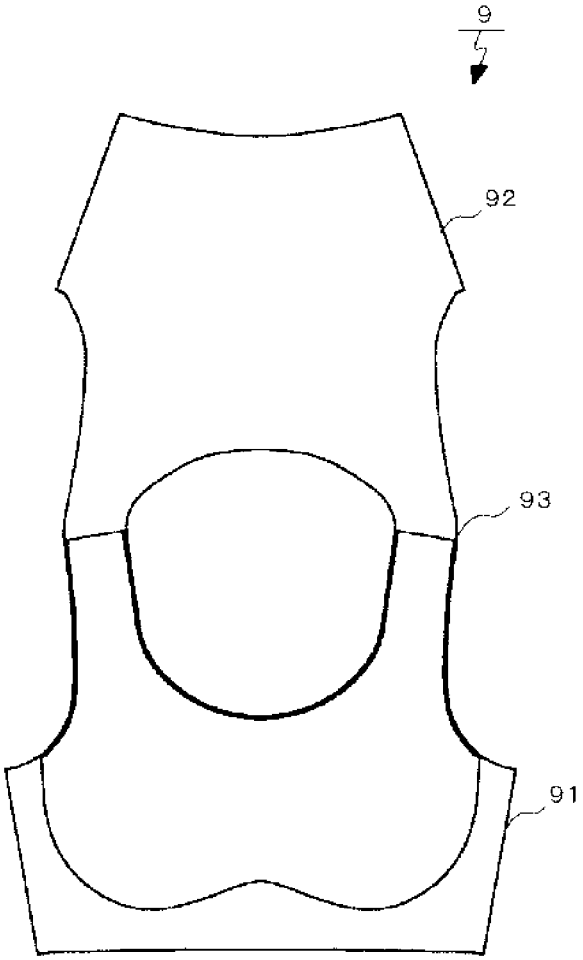
FIG. 1 is a developed view of a conventional brassiere formed only of a material.
Figure 2:
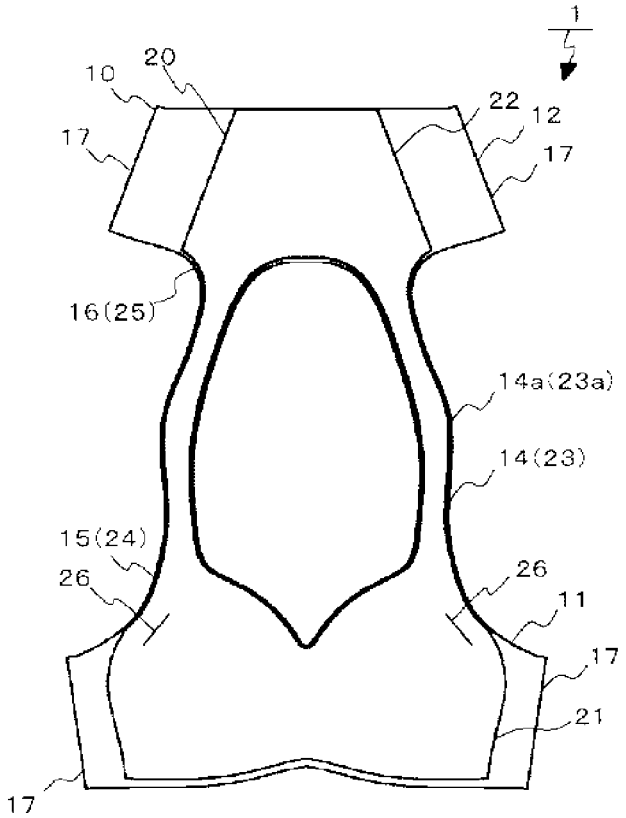
FIG. 2 is a developed view of a brassiere according to a first embodiment of the present invention.
Figure 3:
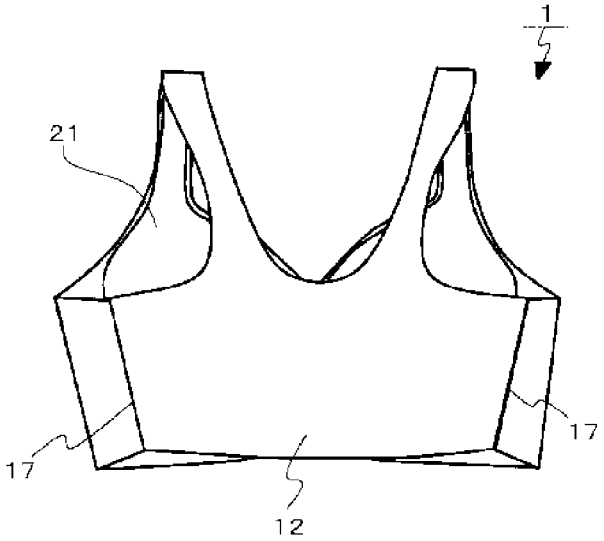
FIG. 3 is a front view of the brassiere according to the first embodiment of the present invention.
Figure 4:
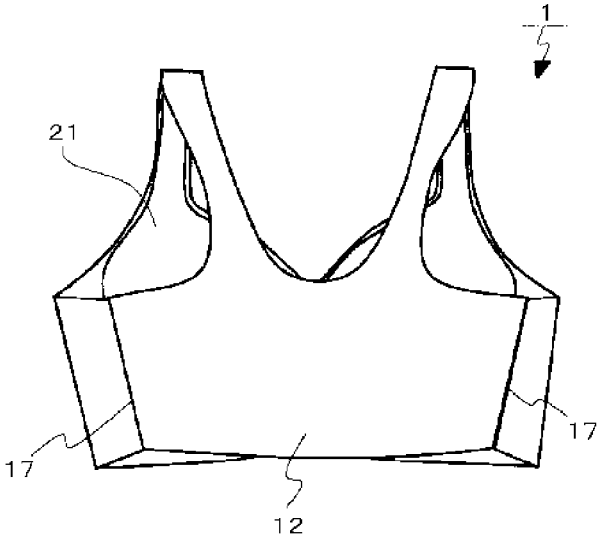
FIG. 4 is a rear view of the brassiere according to the first embodiment of the present invention.

FIG. 2 is a developed view of the brassiere according to the first embodiment of the present invention. FIG. 3 is a front view of the brassiere. FIG. 4 is a rear view of the brassiere.

A brassiere 1 includes a main body cloth 10, and a patch cloth 20 that is attached to the main body cloth 10. The brassiere 1 also includes a main body cloth front part 11 and a main body cloth rear part 12 each having side edge lines 17. The brassiere 1 illustrated in FIGS. 3 and 4 is formed by joining each of the side edge lines 17 of the main body cloth front part 11 to a corresponding one of the side edge lines 17 of the main body cloth rear part 12.

Figure 5:
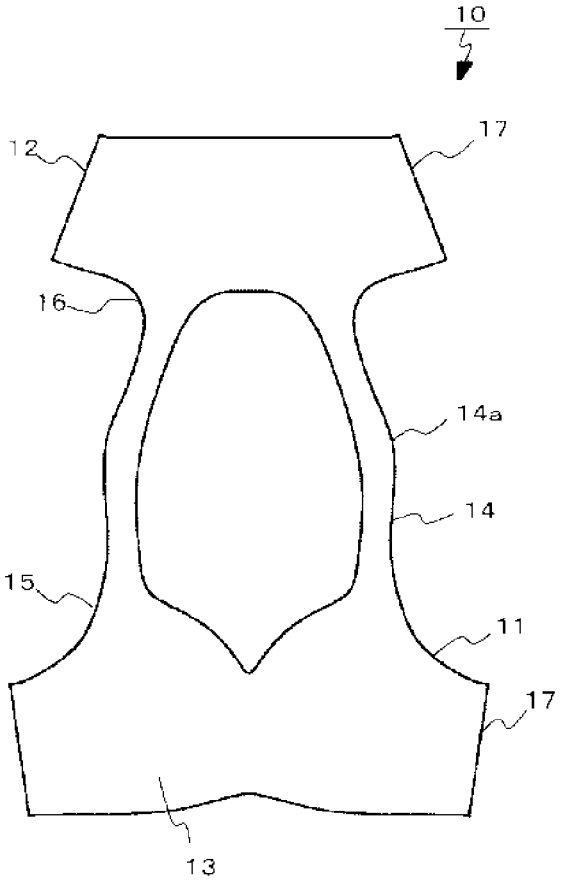
FIG. 5 is a developed view of a main body cloth of the brassiere according to the first embodiment of the present invention.
Figure 6:
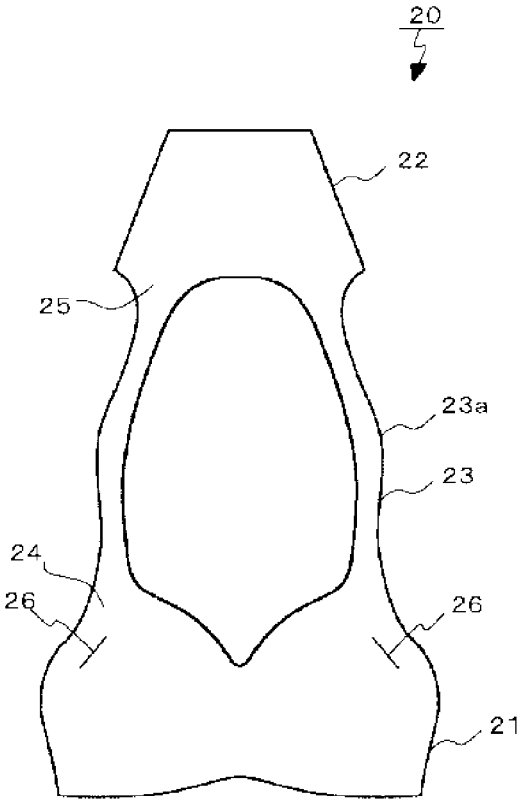
FIG. 6 is a developed view of a patch cloth of the brassiere according to the first embodiment of the present invention.

FIG. 5 is a developed view of the main body cloth 10, and FIG. 6 is a developed view of the patch cloth 20.

As illustrated in FIG. 5, the main body cloth 10 includes the main body cloth front part 11, the main body cloth rear part 12, and a main body cloth shoulder strap 14 that are formed of a single material panel. The main body cloth 10 employs an elastic material, such as a tubular-knitted, wrap-knitted, or weft-knitted material, each having elastic threads made of, for example, nylon or polyurethane. The material has an elasticity in warp and weft directions, the elasticity being as much as, for example, an 80% or more stretch exhibited by a strip sample piece in width of 2.5 cm of the material to which a load of 1.5 kg is applied. The main body cloth 10 preferably employs a typically called free cut material that is available for use without edge finishing, such as overcast stitching on an edge of cloth in each opening.

The main body cloth 10 includes a cup part 13 provided on the main body cloth front part 11. The cup part 13 has a swelled portion molded in the shape of a bust, and the molding prevents the cup part 13 from pressing a breast to provide a good wearing comfort. It is possible to achieve a certain degree of wearing comfort without molding on conditions that the patch cloth 20 is not bonded in a region of the bust part and that each of the main body cloth 10 and the patch cloth 20 is easily stretchable.

The main body cloth front part 11 is larger in width than the main body cloth rear part 12. In this configuration, when the brassiere 1 is formed by joining the side edge lines 17 of the main body cloth front part 11 to the corresponding side edge lines 17 of the main body cloth rear part 12, the side edge lines 17 joined together are placed rearward of underarms of a wearer, and closer to the wearer's back.

The shoulder strap 14 is largest in width (10 to 40 mm) at a main body cloth shoulder strap top portion 14*a* that is placed on top of the wearer's shoulder when the brassiere 1 is worn. The shoulder strap 14 is formed in a shape narrowing in width toward a main body cloth front part joint portion 15 and also toward a main body cloth rear part joint portion 16. The main body cloth shoulder strap top portion 14*a* is approximately 26 mm in width. The shoulder strap 14 is smallest in width in the vicinity of the main body cloth front part joint portion 15 and in the vicinity of the main body cloth rear part joint portion 16, and the width is set at approximately 21 mm. Thus, the shoulder strap 14 is smaller in width than a shoulder strap of a conventional brassiere employing a free cut material.

The main body cloth front part joint portion 15 corresponds to a border between the shoulder strap 14 and the main body cloth front part 11. The shoulder strap 14 widens at its lower end toward the main body cloth front part joint portion 15 so that the main body cloth front part joint portion 15 is formed in a sector shape.

The main body cloth rear part joint portion 16 corresponds to a border between the shoulder strap 14 and the main body cloth rear part 12. The shoulder strap 14 widens at its lower end toward the main body cloth rear part joint portion 16. Thus, as in a case of the main body cloth front part joint portion 15, the main body cloth rear part joint portion 16 is also formed in a sector shape. The main body cloth rear part joint portion 16 is placed more inward (closer to a center line in a longitudinal direction) than the main body cloth shoulder strap top portion 14*a* and the main body cloth front part joint portion 15. In this configuration, the main body cloth rear part joint portion 16 is arranged inward so as to prevent the shoulder strap from falling off the shoulder.

As illustrated in FIG. 6, the patch cloth 20 includes a patch cloth front part 21, a patch cloth rear part 22, and a patch cloth shoulder strap 23 that are formed of a single material panel. The patch cloth 20 attached to the main body cloth 10 has a substantially similar shape as a whole to the main body cloth 10. However, the patch cloth front part 21 is different in shape from the main body cloth front part 11, and the patch cloth rear part 22 is different in shape from the main body cloth rear part 12. The patch cloth 20 employs, as in a case of the main body cloth 10, an elastic material. The patch cloth 20 may employ a material identical to the material of the main body cloth 10, or may alternatively employ a material having a different elasticity from the material of the main body cloth 10.

As in the case of the main body cloth 10, the shoulder strap 23 is largest in width at a patch cloth shoulder strap top portion 23*a* that is placed on the top of the wearer's shoulder when the brassiere 1 is worn. The shoulder strap 23 is formed in a shape narrowing in width toward a patch cloth front part joint portion 24 and also toward a patch cloth rear part joint portion 25.

The patch cloth front part 21 is different in shape from the main body cloth front part 11 in that the patch cloth front part 21 from a lower end of the cup part toward the patch cloth front part joint portion 24 is formed in a circular arc shape where continuous curves are alternately arranged. In this configuration, a smooth curve is formed from the lower end of the cup part toward the patch cloth front part joint portion 24 and subsequently toward the shoulder strap 23, so that a weight of the breast is efficiently transferred to the shoulder strap 23.

The patch cloth front part joint portion 24 corresponds to a border between the shoulder strap 23 and the patch cloth front part 21. The shoulder strap 23 widens at its lower end toward the patch cloth front part joint portion 24 so that the patch cloth front part joint portion 24 is formed in a sector shape.

The patch cloth rear part 22 has such a shape that its both ends are cut off so as to be approximately half in area of the main body cloth rear part 12.

The patch cloth rear part joint portion 25 corresponds to a border between the shoulder strap 23 and the patch cloth rear part 22. The shoulder strap 23 widens at its lower end toward the patch cloth rear part joint portion 25. Thus, as in the case of the patch cloth front part joint portion 24, the patch cloth rear part joint portion 25 is also formed in a sector shape. The patch cloth rear part joint portion 25 is also placed more inward than the patch cloth shoulder strap top portion 23*a* and the patch cloth front part joint portion 24.

With the configurations described above, the patch cloth 20 is bonded to the main body cloth 10 on which an adhesive (e.g., a hot melt urethane adhesive) is applied (e.g., screen printing application or ink-jet application), thereby forming the brassiere 1.

Figure 7:
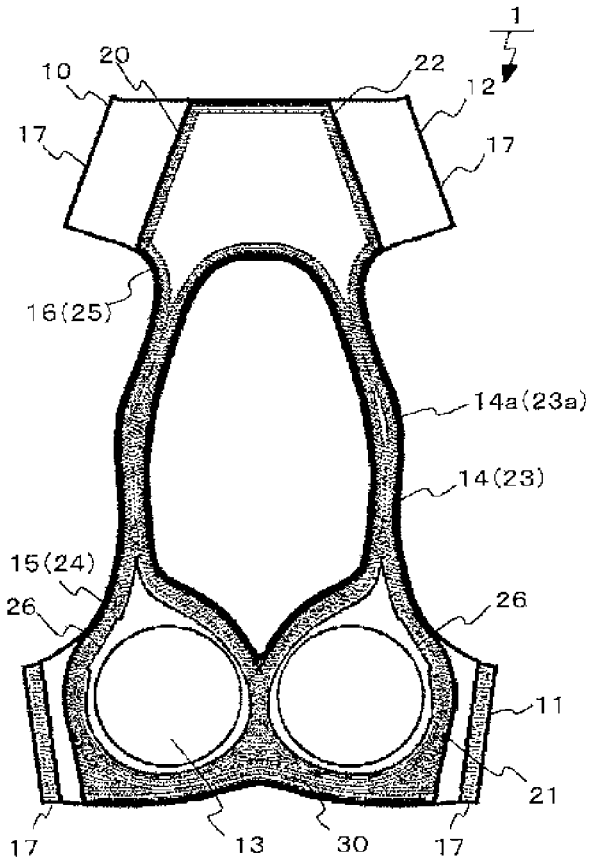
FIG. 7 is a developed view of a bonded region of the brassiere according to the first embodiment of the present invention.

FIG. 7 is a developed view of the bonded region of the brassiere 1.

The brassiere 1 includes a zone having a double-layer structure in which the patch cloth 20 is attached to the main body cloth 10, and a zone formed of a single sheet of cloth (the main body cloth 10 only). The double-layer zone where the patch cloth 20 is attached to the main body cloth 10 requires a more increased force to stretch than the zone formed of a single sheet of cloth, resulting in being less prone to stretch. In addition, a bonded region 30 where the adhesive is applied has a further restriction in stretch, resulting in being even less prone to stretch. In other words, when the brassiere 1 is formed only of a material, an area ratio between the main body cloth 10, the patch cloth 20, and the bonded region 30 is a crucial element that influences the wearing comfort.

An area ratio of the patch cloth 20 to the main body cloth 10 is preferably 65 to 80%. The reason therefor is as follows. The area ratio that is below 65% cannot secure an area required to reinforce the bust part, the shoulder strap, and a rear part. The area ratio that is 80% or more causes a feeling of pressure. In the developed view of FIG. 2, the area ratio is set at approximately 75%. An area ratio of the bonded region 30 to the main body cloth 10 is preferably set at 25 to 75%, within a range not exceeding the area of the patch cloth. An entire surface of the patch cloth 20 may be applied as the bonded region 30. FIG. 7 illustrates an example where the area ratio of the bonded region 30 is approximately 30%.

With regards to the bonded region 30, when a width of approximately 7 mm that the bonded region 30 has in an outer peripheral edge of the patch cloth rear part 22 is expressed as 1, it is desirable to design that the bonded region 30 has a width of 1 to 3 in both sides of the bust part, a width of 1 to 2.5 in a center of the bust part, and a width of 1.5 or more in a lower side of the bust part. It is confirmed that, when the width in the both sides of the bust part and the width in the lower side of the bust part are reduced to, for example, 1 (7 mm), the lower side of the bust part slides up. In FIG. 7, the width of the bonded region 30 in both sides of the bust part is approximately twice as large as the width of the bonded region 30 in the outer peripheral edge of the patch cloth rear part 22, and in the lower side of the bust part, the patch cloth 20 is entirely applied as the bonded region 30.

In the bust part, the bonded region 30 is arranged in a dotted shape by drawing a circle in such a manner as to hold the breast. This configuration helps the weight of the breast to be efficiently transferred to the shoulder strap. The bonded region 30 is extremely small in stretch compared with other zones, easily reaching its stretch limit when some force is applied. In the bonded region 30, force is transferred more than in the region formed only of the main body cloth 10 that is less restricted in stretch. In a case that the bonded region has a sharp corner in its middle position, force spreads in different directions. Thus, in a surrounding zone of the cup part, the bonded region 30 is arranged in a curve without forming a sharp corner, so that force caused by the weight of the breast is efficiently transferred to the shoulder strap.

The main body cloth shoulder strap 14 and the patch cloth shoulder strap 23 are entirely attached to each other as the bonded region 30 so as to gain rigidity and not to become less in width when the brassiere 1 is worn. In order to prevent the shoulder strap from becoming thinner and biting into the shoulder when the brassiere 1 is worn, the shoulder strap has the double-layer structure in which the main body cloth shoulder strap 14 and the patch cloth shoulder strap 23 are attached to each other. This configuration increases a strength against a strength pulling the shoulder strap in a length direction of the shoulder strap by the weight of the breast, and also increases a strength for retaining the width of the shoulder strap. In addition, the adhesive is applied to an entire zone of the shoulder strap, not only an outer peripheral edge of the shoulder strap, as the bonded region 30. The bonded region 30 where the adhesive is applied is restricted in stretch, so that the strength for preventing the material from becoming thinner to retain the width of the shoulder strap is increased. When not the entire zone of the shoulder strap but only both edges of the shoulder strap are bonded, it is confirmed that an unbonded zone in a center of the shoulder strap floats up. Further, the main body cloth front part joint portion 15 and the patch cloth front part joint portion 24, and the main body cloth rear part joint portion 16 and the patch cloth rear part joint portion 25 are set to be smaller in width than the main body cloth shoulder strap top portion 14*a* and the patch cloth shoulder strap top portion 23*a*. In this configuration, when the shoulder strap is pulled in the length direction, the thinnest parts where the power of retaining width is weakest become stretched and narrow and absorb the pulling force. It is thus preferable that the shoulder strap is bonded in the entire zone. While being bonded in the entire zone, an amount of resin in the adhesive may vary between the edges of the shoulder strap and the center of the shoulder strap. Consequently, the main body cloth shoulder strap top portion 14*a* and the patch cloth shoulder strap top portion 23*a* retain the widths that are less prone to be smaller so as to reduce the biting of the shoulder strap into the shoulder. When these portions are smaller in width, the shoulder strap is formed in a sharper shape, providing an attractive appearance.

When the double-layer structure is applied to the shoulder strap only, the rear part of the brassiere 1 may be pulled by the shoulder strap, thereby causing too much upward force and an unstable wearing condition. In this state, a strength in a direction for stabilizing the brassiere 1 with respect to the wearer's body (horizontal strength when the brassiere 1 is worn) is overwhelmed and the rear part of the brassiere 1 slides up at its lower side, making it difficult to maintain an underbust portion in an appropriate position. For this reason, the double-layer structure is also applied to approximately a half of the rear part so that the brassiere 1 is brought into closer contact with the wearer's body.

Figure 8:
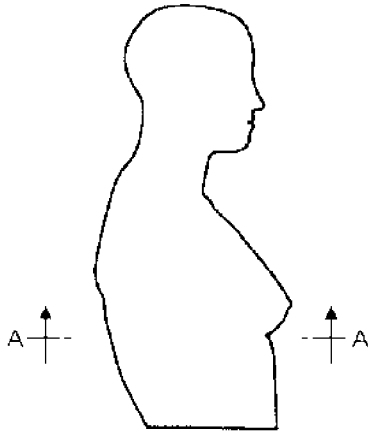
FIG. 8 illustrates an upper half of a wearer's body.
Figure 9:
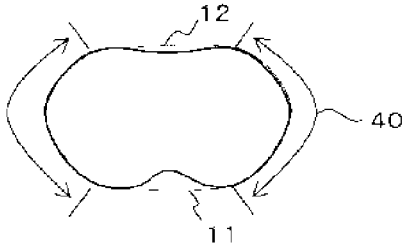
FIG. 9 is a cross-sectional view taken along line A-A in FIG. 8.

The double-layer material zones require an increased force to stretch and thus are less prone to stretch than the zones formed only of the main body cloth 10. In a contrast, each of the underarm parts formed only of the main body cloth 10 is more easily stretchable than the double-layer zone in the main body cloth front part 11 and the patch cloth front part 21 covering the breast, as well as the double-layer zone in the main body cloth rear part 12 and the patch cloth rear part 22 formed from a center of the back to the underarms. FIG. 8 illustrates an upper half of the wearer's body, and FIG. 9 is a cross-sectional view taken along line A-A in FIG. 8. In each side body portion 40 where a contact area with the wearer's skin is increased, each of the underarm parts formed only of the main body cloth 10 stretches well, reducing slack in the material, so as to come into closer contact tightly with the wearer's body than in a case that only the front side of brassiere 1 has the double-layer structure. In addition, each of the underarm parts formed of a single cloth is soft and thus more easily comes into contact with a curved surface of the wearer's body. With these parts coming into closer contact with the wearer's body, even when the shoulder strap has the double-layer structure, increasing the force pulling the rear part of the brassiere 1 upward, it is possible to bring the brassiere into contact with the wearer's body without clearance instead of being overwhelmed by the force, and prevent the underbust portion from sliding up, thereby resulting in a stable wearing comfort.

It is possible to adjust a size or a tightness of fit of the brassiere 1 to the wearer's body by modifying an area of the double-layer zone in the main body cloth rear part 12 and the patch cloth rear part 22. When the cloth employs a material having low strength and thus is easily stretchable, an entire zone of the rear part of the brassiere 1 may have the double-layer structure. In this case, an area ratio of the double-layer zone is 100% to the rear part of the brassiere 1 in a width direction of the rear part. However, when the cloth employs a material of which a strip sample piece in width of 2.5 cm has an approximately 80% to 160% stretch at the load of 1.5 kg, the area preferably covers 30% to 70% of the rear part of the brassiere 1 in the width direction.

When the double-layer structure is applied to an entire zone of the back, the strength of the cloth becomes too high, so that the brassiere 1 may not only be uncomfortably worn or removed but also press the breast unnaturally, reducing the soft and tender wearing comfort. In a contrast, when the double-layer structure is applied to 30% or less of the entire zone of the back, the width of the double-layer zone becomes similar to the width of each of the shoulder straps so that the force transferred from the shoulder strap is exerted intensively on this narrow double-layer region. Then, only the double-layer zone slides upward, causing the unstable wearing condition. For this reason, it is preferable that the double-layer zone in the rear part extends left to right from a center of the rear part and has a width set at between 30% or more and 70% or less of the width of the rear part.

The main body cloth front part joint portion 15, the patch cloth front part joint portion 24, the main body cloth rear part joint portion 16, and the patch cloth rear part joint portion 25 are all formed in a sector shape, so as to control a direction of force. In the rear part of the brassiere 1, the patch cloth 20 has a shape extending from the patch cloth shoulder strap 23 and, instead of reaching a lower side of the patch cloth rear part 22, widening at the lower end of the patch cloth shoulder strap 23 in a direction toward each of the underarm parts. In this configuration, the upward force transferred from the shoulder strap spreads in the direction toward each of the underarm parts, that is, in the direction of left to right, so as to reduce the force pulling the rear part upward and thus prevent the rear part from sliding up.

Figure 10:
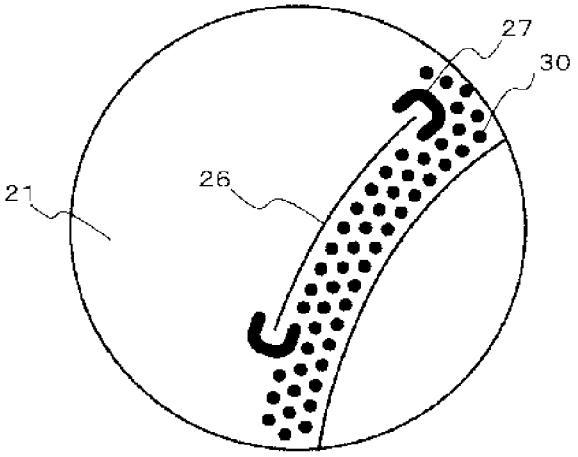
FIG. 10 is an enlarged view of around a pad insertion section of the brassiere according to the first embodiment of the present invention.

The patch cloth 20 also includes a pad insertion section 26 that is a slit for inserting a pad into the bust part of the patch cloth front part 21. FIG. 10 is an enlarged view of and around the pad insertion section 26. A repeated insertion of the pad may cause the material to be torn from each of ends of the pad insertion section 26. The pad insertion section 26 has a tearing preventive portion 27 of U-shape formed in the bonded region in such a manner as to enclose each of the ends of the slit to limit tearing of the material within the ends of the pad insertion section 26.

As described above, the brassiere 1 of this embodiment employs a double-layer elastic material in the bust part of the front part (the surrounding zone of the bust part or the entire zone of the bust part), the shoulder strap, and the region in the rear part extending in a predetermined width from the center of the rear part. In the brassiere 1, these regions are different in stretch from the remaining regions (e.g., each of the underarm parts) by an adjustment of the amount or the region of the adhesive applied, resulting in restricted stretch. In these regions, the top of shoulder strap is made less prone to stretch than the front part joint portion and the rear part joint portion so as to prevent the shoulder strap from becoming thinner and biting into the shoulder and achieve an excellent wearing comfort. Further, in a zone of the front part where the stretch is restricted, the region from the lower end of the cup part toward the border between the front part and the shoulder strap is formed in the continuously smooth curve toward the shoulder strap, so that the weight of the breast is efficiently transferred to the shoulder strap. In order to cause the material to be less prone to stretch by restricting the stretch, as previously described, it is possible to increase the width or increase the laminated cloth zone compared with other zones, and also is possible to employ a material having a different knitted structure. Alternatively, these methods may be combined with one another.

Next, a second embodiment will be described with reference to a camisole.

Figure 11:
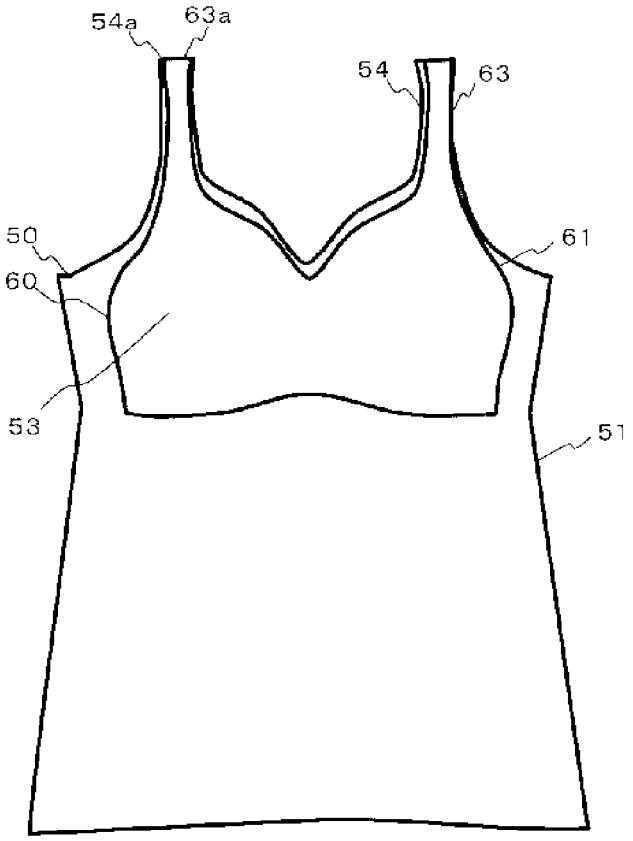
FIG. 11 is a developed view of a front part of a camisole according to a second embodiment of the present invention.
Figure 12:
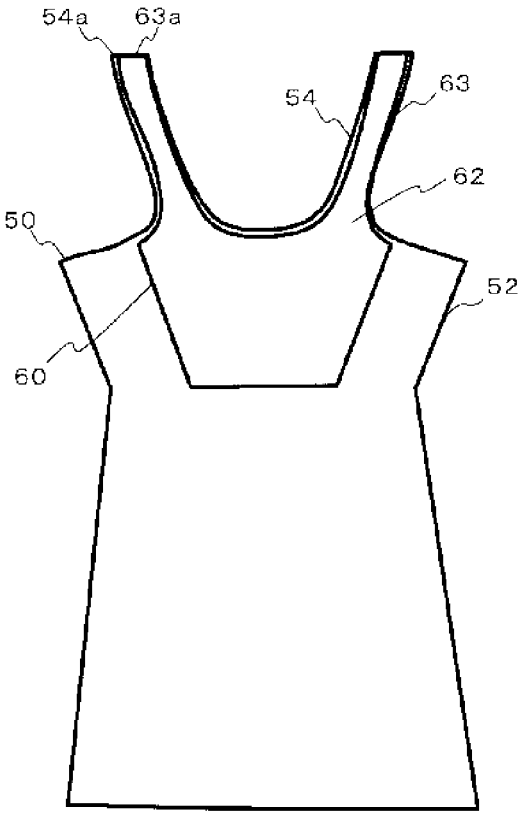
FIG. 12 is a developed view of a rear part of the camisole according to the second embodiment of the present invention.
Figure 13:
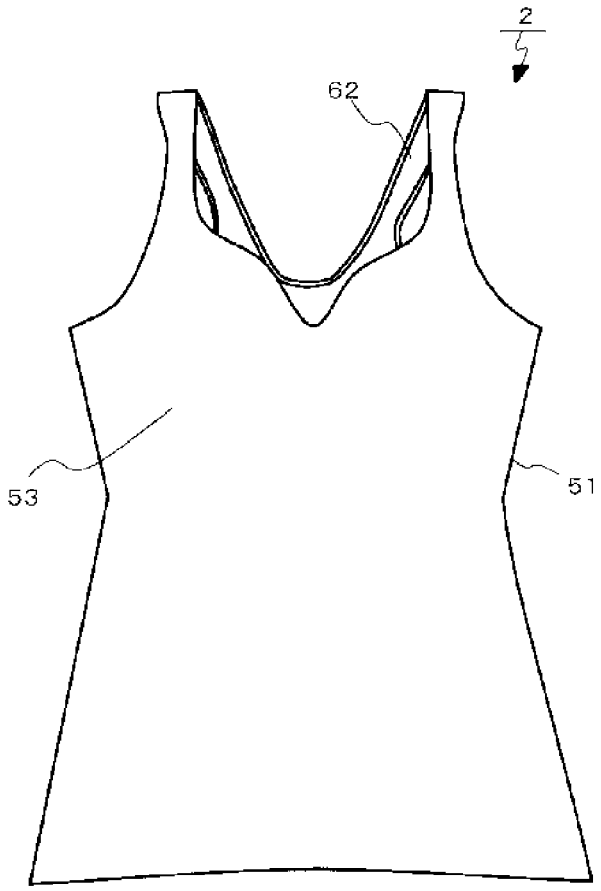
FIG. 13 is a front view of the camisole according to the second embodiment of the present invention.
Figure 14:
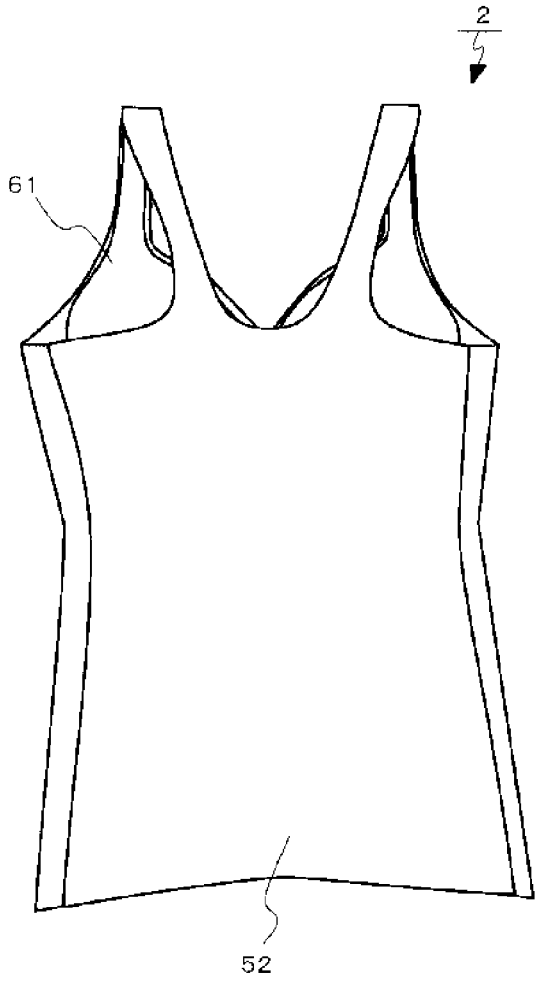
FIG. 14 is a rear view of the camisole according to the second embodiment of the present invention.

FIG. 11 is a developed view of a front part of a camisole according to a second embodiment of the present invention. FIG. 12 is a developed view of a rear part of the camisole. FIG. 13 is a front view of the camisole. FIG. 14 is a rear view of the camisole.

A camisole 2 is different from the brassiere 1 in that a main body cloth 50 includes a main body cloth front part 51 and a main body cloth rear part 52 that are separated from each other. The main body cloth front part 51 and the main body cloth rear part 52 separated from each other need to be bonded to each other at a main body cloth shoulder strap top portion 54*a*. In a contrast, as in the case of the brassiere 1, a patch cloth 60 includes a patch cloth front part 61, a patch cloth rear part 62, and a patch cloth shoulder strap 63 that are formed of a single material panel. The patch cloth 60 also has a bonded region similar to the bonded region of the brassiere 1. The camisole 2 has a double-layer region in which the patch cloth 60 is attached to the main body cloth 50. The region is arranged above a cup part 53 and in the region, an area ratio of the patch cloth 60 to the main body cloth 50 is approximately 75% as in the case of the brassiere 1.

The camisole 2 has similar content, except for the difference described above, to the description of the brassiere 1, and also has an advantageous effect similar to brassiere 1.

The foregoing description concerns a clothing article having a cup part according to an embodiment of the present invention; however, the present invention is not limited to the foregoing embodiment, and thus various modifications and changes in design may be made for purpose of achieving an object of the present invention and without departing from the scope of the present invention. These modifications and changes in design are also encompassed within the technical range of the present invention.

For example, in the foregoing embodiment, an example where a patch cloth is attached to a main body cloth to form a double-layer structure is described. Alternatively, the clothing article may be formed only of the main body cloth. In this case, instead of employing a patch cloth, it is possible to modify a thickness of the main body cloth in some zone or to employ a material having a knitted structure less prone to stretch in some zone.

INDUSTRIAL APPLICABILITY

The present invention is usable as a clothing article having a cup part, such as a brassiere or a camisole.

REFERENCE SIGNS LIST

1, 9: brassiere
2: camisole
10, 50: main body cloth
11, 51: main body cloth front part
12, 52: main body cloth rear part
13, 53: cup part
14, 54: main body cloth shoulder strap
14*a*, 54*a*: main body cloth shoulder strap top portion
15: main body cloth front part joint portion
16: main body cloth rear part joint portion
17: side edge line
20, 60: patch cloth
21, 61: patch cloth front part
22, 62: patch cloth rear part
23, 63: patch cloth shoulder strap
23*a*, 63*a*: patch cloth shoulder strap top portion
24: patch cloth front part joint portion
25: patch cloth rear part joint portion
26: pad insertion section
27: tearing preventive portion
30: bonded region
40: side body portion
91: front part
92: rear part
93: shoulder strap

The invention claimed is:

1. A clothing article having a cup part,
the clothing article comprising:
a front part including the cup part;
a rear part; and
a shoulder strap, the front part, the rear part, and the shoulder strap are formed of an elastic material, the shoulder strap is continuously formed with the front part and the rear part, the shoulder strap is less prone to stretch at a top of the shoulder strap than at a border between the shoulder strap and the front part and at a border between the shoulder strap and the rear part, the border between the shoulder strap and the rear part is arranged more inward than the top of the shoulder strap and the border between the shoulder strap and the front part, the front part, the rear part, and the shoulder strap includes a main body cloth formed of the elastic material and a patch cloth formed of the elastic material, the main body cloth and the patch cloth being bonded to each other, and an area ratio of the patch cloth to the main body cloth is between 65 to 80%, and
a bust part of the front part, the shoulder strap, and a region in the rear part extending in a predetermined width from a center of the rear part includes a double-layer elastic material, the main body cloth and the patch cloth being bonded to each other, and are less prone to stretch than a remainder of:

the front part, the shoulder strap, and the region in the rear part not including the bust part.

2. The clothing article according to claim 1, wherein the front part, the rear part, and the shoulder strap are formed of a single sheet of continuous elastic material.

3. The clothing article according to claim 1, wherein the shoulder strap is larger in width at the top of the shoulder strap than at the border between the shoulder strap and the front part and at the border between the shoulder strap and the rear part.

4. The clothing article according to claim 1, wherein at the border between the shoulder strap and the front part and at the border between the shoulder strap and the rear part, the shoulder strap is formed in a sector shape, widening at a lower end of the shoulder strap toward the front part and at a lower end of the shoulder strap toward the rear part.

5. The clothing article according to claim 1, wherein in a region of the front part that is less prone stretch than the remainder of the front part, a region from a lower end of the cup part toward a border between the front part and the shoulder strap is formed in a continuous curve toward the shoulder strap.

6. The clothing article according to claim 1, wherein a pair of underarm parts are formed only of the main body cloth.

7. The clothing article according to claim 1, wherein a double-layer zone in the rear part extends left to right from a center of the rear part and has a width set at between 30% and 70% of the width of the rear part.

* * * * *